US011352871B2

(12) United States Patent
Pabon et al.

(10) Patent No.: US 11,352,871 B2
(45) Date of Patent: Jun. 7, 2022

(54) SLIDE DRILLING OVERSHOT CONTROL

(71) Applicant: SCHLUMBERGER TECHNOLOGY CORPORATION, Sugar Land, TX (US)

(72) Inventors: Jahir Pabon, Newton, MA (US); Nathaniel Wicks, Somerville, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 156 days.

(21) Appl. No.: 16/871,599

(22) Filed: May 11, 2020

(65) Prior Publication Data

US 2021/0348494 A1 Nov. 11, 2021

(51) Int. Cl.
*E21B 44/04* (2006.01)
*E21B 7/06* (2006.01)
*E21B 3/025* (2006.01)

(52) U.S. Cl.
CPC ..... *E21B 44/04* (2013.01); *E21B 3/025* (2013.01); *E21B 7/06* (2013.01)

(58) Field of Classification Search
CPC ..... E21B 44/04; E21B 3/025; E21B 7/06
See application file for complete search history.

(56) References Cited

U.S. PATENT DOCUMENTS 6,050,348 A 4/2000 Richarson et al.
6,338,390 B1 1/2002 Tibbitts
6,918,453 B2 7/2005 Haci et al.
7,096,979 B2 8/2006 Haci et al.
7,152,696 B2 12/2006 Jones
7,404,454 B2 7/2008 Hulick
7,461,705 B2 12/2008 Hulick et al.
7,588,100 B2 9/2009 Hamilton
7,802,634 B2 9/2010 Boone
7,810,584 B2 10/2010 Haci et al.
(Continued)

FOREIGN PATENT DOCUMENTS

EP 2935774 B1 8/2018
WO 2011140625 A1 11/2011

OTHER PUBLICATIONS

Nabors, ROCKit® System, 4 pages, Accessed May 8, 2020, https://www.nabors.com/software/performance-drilling-software/rockit-system.

(Continued)

*Primary Examiner* — Nicole Coy

(57) ABSTRACT

Apparatus and operational methods thereof, including a top drive, a rotation sensor, and a processing device. The top drive connects with an upper end of a drill string. The rotation sensor facilitates rotational distance measurements indicative of rotational distance achieved by the top drive. The processing device causes the top drive to impart rotational oscillations alternatingly in opposing directions to the upper end of the drill string while maintaining a downhole toolface orientation during a slide drilling operation, such that each rotational oscillation rotates the upper end of the drill string through a base rotational distance. The processing device also causes the top drive to change the downhole toolface orientation by an offset rotational distance by adding the offset rotational distance and an overshoot rotational distance to the base rotational distance of an instance of the rotational oscillations.

18 Claims, 6 Drawing Sheets

(56) References Cited

U.S. PATENT DOCUMENTS

| | | | | |
|---|---|---|---|---|
| 7,823,655 | B2 | 11/2010 | Boone et al. | |
| 8,360,171 | B2 | 1/2013 | Boone et al. | |
| 8,387,720 | B1 | 3/2013 | Keast et al. | |
| 8,528,663 | B2 | 9/2013 | Boone | |
| 8,602,126 | B2 | 12/2013 | Boone et al. | |
| 8,672,055 | B2 | 3/2014 | Boone et al. | |
| RE44,956 | E | 6/2014 | Richardson et al. | |
| RE44,973 | E | 7/2014 | Richardson et al. | |
| 8,939,233 | B2 * | 1/2015 | Edbury | E21B 37/00 175/26 |
| 8,939,234 | B2 | 1/2015 | Mebane, III et al. | |
| 9,145,768 | B2 | 9/2015 | Normore et al. | |
| 9,249,655 | B1 | 2/2016 | Keast et al. | |
| 9,290,995 | B2 | 3/2016 | Boone et al. | |
| 9,309,760 | B2 | 4/2016 | Haci et al. | |
| 9,359,881 | B2 | 6/2016 | DiSantis | |
| 9,404,307 | B2 * | 8/2016 | Maidla | E21B 47/12 |
| 9,506,336 | B2 | 11/2016 | Orbell | |
| 9,593,567 | B2 | 3/2017 | Pink et al. | |
| 9,650,880 | B2 | 5/2017 | Bowley et al. | |
| 9,784,035 | B2 * | 10/2017 | Boone | E21B 7/04 |
| 10,054,917 | B2 | 8/2018 | Penn et al. | |
| 10,221,672 | B2 * | 3/2019 | Alturbeh | H02P 21/06 |
| 10,378,282 | B2 * | 8/2019 | Hadi | E21B 47/12 |
| 10,883,356 | B2 * | 1/2021 | Jeffryes | E21B 44/02 |
| 2007/0256861 | A1 | 11/2007 | Hulick | |
| 2015/0107899 | A1 | 4/2015 | Fisher, Jr. et al. | |
| 2016/0168973 | A1 | 6/2016 | Dykstra et al. | |
| 2016/0237802 | A1 | 8/2016 | Boone et al. | |
| 2016/0245067 | A1 | 8/2016 | Haci et al. | |
| 2018/0328113 | A1 | 11/2018 | Penn et al. | |
| 2020/0095829 | A1 * | 3/2020 | Gajic | E21B 21/08 |
| 2020/0378237 | A1 * | 12/2020 | Wicks | E21B 7/068 |

OTHER PUBLICATIONS

Schlumberger, Slider, accessed May 8, 2020, 7 pages, https://useslider.com/.

Search Report and Written Opinion of International Patent Application No. PCT/US2021/031574 dated Aug. 24, 2021; 10 pages.

* cited by examiner

SLIDE DRILLING OVERSHOT CONTROL

BACKGROUND OF THE DISCLOSURE

Wells are generally drilled into the ground or ocean bed to recover natural deposits of oil, gas, and other materials that are trapped in subterranean formations. Well construction operations (e.g., drilling operations) may be performed at a wellsite by a drilling system (e.g., drilling rig) having various automated surface and subterranean equipment operating in a coordinated manner. For example, a drive mechanism, such as a top drive located among wellsite surface equipment, can be utilized to rotate and advance a drill string into a subterranean formation to drill a wellbore. The drill string may include a plurality of drill pipes coupled together and terminating with a drill bit. The length of the drill string may be increased by adding additional drill pipes while depth of the wellbore increases. Drilling fluid may be pumped from the wellsite surface down through the drill string to the drill bit. The drilling fluid lubricates and cools the drill bit and carries drill cuttings from the wellbore back to the wellsite surface. The drilling fluid returning to the surface may then be cleaned and again pumped through the drill string. The equipment of the drilling system may be grouped into various subsystems, wherein each subsystem performs a different operation controlled by a corresponding local and/or remotely located controller.

The wellsite equipment is monitored and controlled from a control center located at the wellsite surface. The control center houses a control station operable to receive sensor measurements from various sensors associated with the wellsite equipment. The wellsite equipment may be automatically controlled by the control station, or manually controlled by a wellsite operator, based on the sensor measurements.

The wellbore may be drilled via directional drilling by selectively rotating the drill bit via the top drive and/or a mud motor of a bottom-hole assembly (BHA) proximate the drill bit. Directional drilling performed while the drill bit is oriented in an intended direction by the top drive and rotated by the mud motor is known in the oil and gas industry as slide drilling. During slide drilling, at least a portion of the drill string slides along a sidewall of the wellbore, thereby reducing the amount of drill string weight that is transferred to the drill bit because of axial friction between the sidewall of the wellbore and the drill string. A reduced weight-on-bit (WOB) causes a reduced axial contact force between the drill bit and the formation being cut by the drill bit, resulting in a reduced rate of penetration (ROP) through the formation.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a top drive, a rotation sensor, and a processing device. The top drive is for connection with an upper end of a drill string. The rotation sensor is operable to facilitate rotational distance measurements indicative of rotational distance achieved by the top drive. The processing device includes a processor and a memory storing computer program code. The processing device is operable to cause the top drive to impart rotational oscillations alternatingly in opposing directions to the upper end of the drill string while maintaining a downhole toolface orientation during a slide drilling operation such that each rotational oscillation rotates the upper end of the drill string through a base rotational distance. The processing device is also operable to cause the top drive to change the downhole toolface orientation by an offset rotational distance by adding the offset rotational distance and an overshoot rotational distance to the base rotational distance of an instance of the rotational oscillations.

The present disclosure also introduces a method that includes commencing operation of a processing device communicatively connected to a top drive of a well construction system. The processing device operation causes the top drive to impart rotational oscillations in alternating opposite directions to an upper end of a drill string while maintaining a downhole toolface orientation during a slide drilling operation. Each rotational oscillation is through a base rotational distance. The processing device operation also causes the top drive to change the downhole toolface orientation by an offset rotational distance by adding the offset rotational distance and an overshoot rotational distance to the base rotational distance of an instance of the rotational oscillations.

The present disclosure also introduces a method that includes commencing operation of a processing device communicatively connected to a well construction system having a top drive. The processing device operation causes the top drive to impart rotational oscillations in alternating first and second opposite directions to an upper end of a drill string while maintaining a downhole toolface orientation during a slide drilling operation. Each rotational oscillation is through a base rotational distance. The processing device operation also causes the top drive to change the downhole toolface orientation by an offset rotational distance by adding the offset rotational distance and an overshoot rotational distance to the base rotational distance of an instance of the rotational oscillations in the first direction, and by adding the overshoot rotational distance to the base rotational distance of an instance of the rotational oscillations in the second direction.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
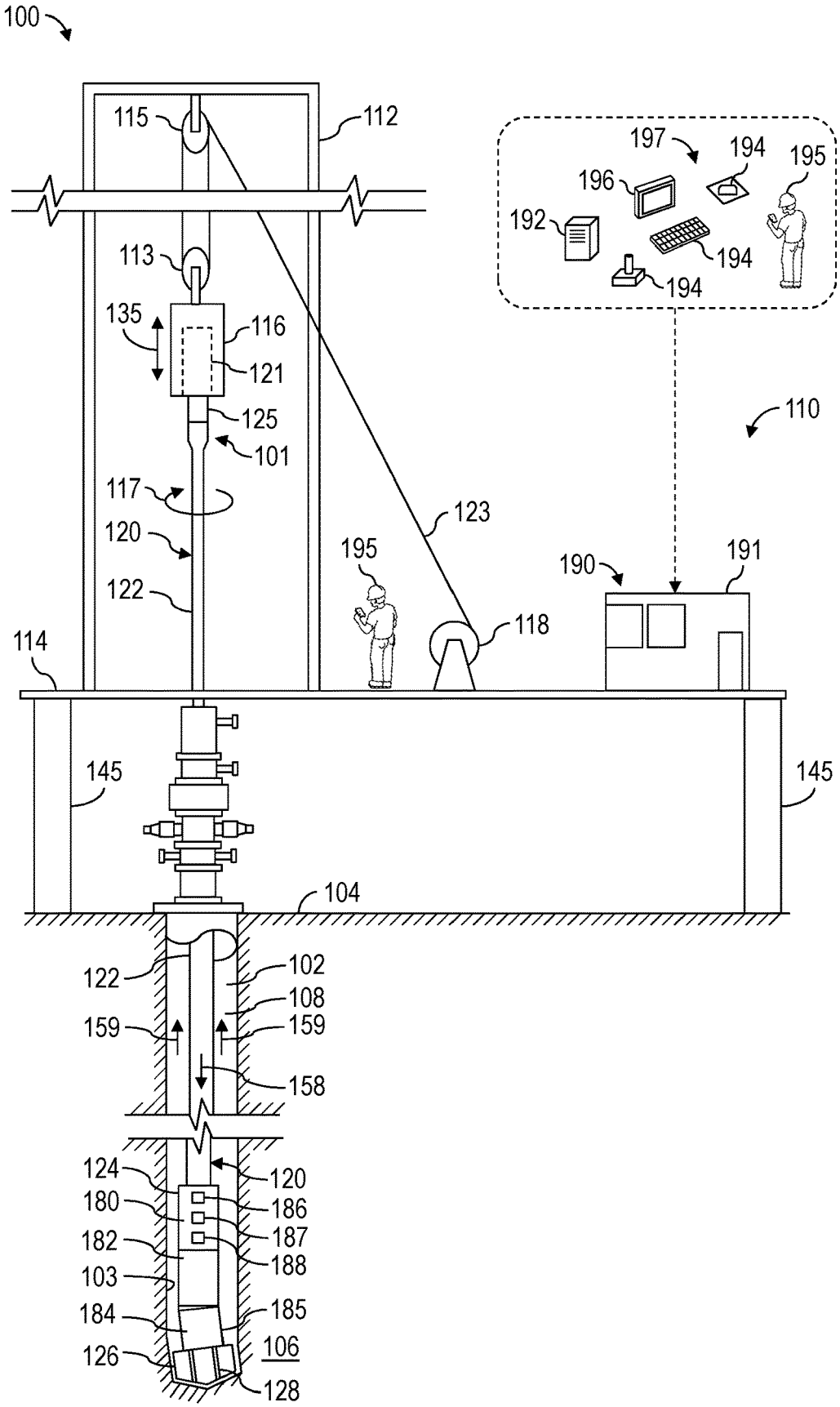
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity and does not in itself dictate a relationship between the various embodiments and/or configurations discussed.

Systems and methods (e.g., processes, operations) according to one or more aspects of the present disclosure may be used or performed in association with a well construction system at a wellsite, such as for constructing a wellbore to obtain hydrocarbons (e.g., oil and/or gas) or other natural resources from a subterranean formation. A person having ordinary skill in the art will readily understand that one or more aspects of systems and methods disclosed herein may be utilized in other industries and/or in association with other systems.

FIG. 1 is a schematic view of at least a portion of an example implementation of a well construction system 100 according to one or more aspects of the present disclosure. The well construction system 100 represents an example environment in which one or more aspects introduced in the present disclosure may be implemented. The well construction system 100 may be or comprise a well construction (e.g., drilling) rig. Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 comprises well construction equipment, such as surface equipment 110 located at the wellsite surface 104 and a drill string 120 suspended within the wellbore 102. The surface equipment 110 may include a mast, a derrick, and/or other support structure 112 disposed over a rig floor 114. The drill string 120 may be suspended within the wellbore 102 from the support structure 112. The support structure 112 and the rig floor 114 are collectively supported over the wellbore 102 by legs and/or other support structures 145. Certain pieces of surface equipment 110 may be manually operated (e.g., by hand, via a local control panel) by rig personnel 195 (e.g., a roughneck or another human rig operator) located at various portions (e.g., rig floor 114) of the well construction system 100.

The drill string 120 may comprise a BHA 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated by a top drive 116 and/or a downhole mud motor 182 connected with the drill bit 126. The mud motor 182 may be a directional mud motor comprising a bent sub 184 (e.g., housing), which may be oriented in a predetermined direction during drilling operations to orient the drill bit 126 and, thus, steer the drill string 120 along a predetermined path through the formation 106. The side of the mud motor 182 aligned with the direction of the bent sub 184 and the drill bit 126 may be referred to hereinafter as "a downhole toolface" 185.

The BHA 124 may also include one or more downhole tools 180 above and/or below the mud motor 182. One or more of the downhole tools 180 may be or comprise a measurement-while-drilling (MWD) or logging-while-drilling (LWD) tool comprising downhole sensors 188 operable for the acquisition of measurement data pertaining to the BHA 124, the wellbore 102, and/or the formation 106. The downhole sensors 188 may comprise an inclination sensor, a rotational position sensor, and/or a rotational speed sensor, which may include one or more accelerometers, magnetometers, gyroscopic sensors (e.g., micro-electro-mechanical system (MEMS) gyros), and/or other sensors for determining the orientation, position, and/or speed of one or more portions of the BHA 124 (e.g., the drill bit 126, a downhole tool 180, and/or the mud motor 182) and/or other portions of the drill string 120 relative to the wellbore 102 and/or the wellsite surface 104. The downhole sensors 188 may comprise a depth correlation tool utilized to determine and/or log position (i.e., depth) of one or more portions of the BHA 124 and/or other portions of the drill string 120 within the wellbore 102 and/or with respect to the wellsite surface 104.

One or more of the downhole tools 180 and/or another portion of the BHA 124 may also comprise a telemetry device 186 operable to communicate with the surface equipment 110 via mud-pulse, electro-magnetic, and/or other forms of telemetry. One or more of the downhole tools 180 and/or another portion of the BHA 124 may also comprise a downhole control device 187 (e.g., a processing device, an equipment controller, etc.) operable to receive, process, and/or store data received from the surface equipment 110, the downhole sensors 188, and/or other portions of the BHA 124. The control device 187 may also store executable computer programs (e.g., program code instructions), including for implementing one or more aspects of the operations described herein.

The support structure 112 may support the top drive 116, which is operable to connect (perhaps indirectly) with an upper end 101 of the drill string 120, and to impart rotary motion 117 and vertical motion 135 (via operation of a drawworks 118) to the drill string 120, including the drill bit 126. However, another driver, such as a kelly and a rotary table (neither shown), may be utilized in addition to or instead of the top drive 116 to impart the rotary motion 117 to the drill string 120. The top drive 116 and the connected drill string 120 may be suspended from the support structure 112 via a hoisting system or equipment, which may include a traveling block 113, a crown block 115, and the drawworks 118 storing a support cable or line 123. The crown block 115 may be connected to or otherwise supported by the support structure 112, and the traveling block 113 may be coupled with the top drive 116. The drawworks 118 may be mounted on or otherwise supported by the rig floor 114. The crown block 115 and traveling block 113 comprise pulleys or sheaves around which the support line 123 is reeved to operatively connect the crown block 115, the traveling block 113, and the drawworks 118 (and perhaps an anchor, not shown). The drawworks 118 may, thus, selectively impart tension to the support line 123 to lift and lower the top drive 116, resulting in the vertical motion 135. The drawworks 118 may comprise a drum, a base, and a prime mover (e.g., an engine or motor, not shown) operable to drive the drum to rotate and reel in the support line 123, causing the traveling block 113 and the top drive 116 to move upward. The drawworks 118 may be further operable to reel out the support line 123 via a controlled rotation of the drum, causing the traveling block 113 and the top drive 116 to move downward.

The top drive 116 comprises a drive shaft 125 operatively connected with a prime mover (e.g., an electric motor) 121 of the top drive 116, such as via a gear box or transmission (not shown). The drive shaft 125 is selectively coupled with the drill string upper end 101, perhaps via a saver sub or other intervening component (not shown). The prime mover 121 is selectively operated to rotate the drive shaft 125 and, when connected, the drill string 120. Thus, during drilling operations, the top drive 116, in conjunction with operation of the drawworks 118, advances the drill string 120 into the formation 106 to form the wellbore 102.

The well construction system 100 also includes a drilling fluid circulation system (not shown) operable to pump drilling fluid internally through the drill string 120, as indicated by directional arrow 158. The drilling fluid exits ports 128 in the drill bit 126 and then flows uphole through the annular space 108 defined between an exterior of the drill string 120 and the sidewall of the wellbore 102, such flow being indicated by directional arrows 159. In this manner, the drilling fluid lubricates the drill bit 126 and carries formation cuttings uphole to the wellsite surface 104. The drilling fluid flowing downhole through the drill string 120 may also selectively actuate the mud motor 182 to rotate the drill bit 126 instead of or in addition to the rotation of the drill string 120 via the top drive 116. Accordingly, rotation of the drill bit 126 caused by the top drive 116 and/or mud motor 182 may advance the drill string 120 through the formation 106 to form the wellbore 102.

The surface equipment 110 of the well construction system 100 may also comprise a control center 190 from which various portions of the well construction system 100, such as a drill string rotation system (e.g., the top drive 116 and/or a rotary table), a hoisting system (e.g., the drawworks 118 and the blocks 113, 115), a tubular handling system (e.g., a catwalk, one or more iron roughnecks, and one or more tubular handling devices, none shown), a drilling fluid circulation system (e.g., one or more mud pumps and various fluid conduits, none shown), a drilling fluid cleaning and reconditioning system (e.g., various drilling fluid reconditioning equipment and associated containers, not shown), a well control system (e.g., a BOP stack and a choke manifold, neither shown), and the BHA 124, among other examples, may be monitored and controlled. The control center 190 may be located on the rig floor 114 or another location of the well construction system 100, such as the wellsite surface 104. The control center 190 may comprise a facility 191 (e.g., a room, a cabin, a trailer, etc.) containing a control workstation 197, which may be operated by rig personnel 195 (e.g., a driller or another human rig operator) to monitor and control various wellsite equipment or portions of the well construction system 100.

The control workstation 197 may comprise or be communicatively connected with a surface control device 192 (e.g., a processing device, an equipment controller, etc.), such as may be operable to receive, process, and output information to monitor operations of and provide control to one or more portions of the well construction system 100. For example, the control device 192 may be communicatively connected with the various surface and downhole equipment described herein, and may be operable to receive signals (e.g., sensor data, sensor measurements, etc.) from and transmit signals (e.g., control data, control signals, control commands, etc.) to the equipment to perform various operations described herein. The control device 192 may store executable program code, instructions, and/or operational parameters or setpoints, including for implementing one or more aspects of methods and operations described herein. The control device 192 may be located within and/or outside of the facility 191.

The control workstation 197 may be operable for entering or otherwise communicating control commands to the control device 192 by the rig personnel 195, and for displaying or otherwise communicating information from the control device 192 to the rig personnel 195. The control workstation 197 may comprise a plurality of human-machine interface (HMI) devices, including one or more input devices 194 (e.g., a keyboard, a mouse, a joystick, a touchscreen, etc.) and one or more output devices 196 (e.g., a video monitor, a touchscreen, a printer, audio speakers, etc.). Communication between the control device 192, the input and output devices 194, 196, and the various wellsite equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100 and are within the scope of the present disclosure.

The well construction system 100 may be utilized to perform directional drilling by selectively rotating the drill bit 126 via the top drive 116 and/or the mud motor 182. During non-directional drilling operations ("rotary drilling"), both the top drive 116 and the mud motor 182 may rotate the drill bit 126, resulting in a total drill bit rotational rate that is equal to the combined rotational rates of the top drive 116 and the mud motor 182. To cause the drill string 120 to drill in an intended lateral direction (i.e., to turn), the top drive 116 may stop rotating and then orient the downhole toolface 185 in the intended direction. The mud motor 182 may then continue to rotate the drill bit 126 while weight-on-bit is applied, thereby causing the drill string 120 to advance through the formation 106 to extend the wellbore 102 in the intended direction (the direction of the downhole toolface). Directional drilling performed while the drill bit 126 is oriented in the intended direction by the top drive 116 and rotated by the mud motor 182 is known in the oil and gas industry as "slide drilling." Rotary and slide drilling operations may be alternated to steer the drill string 120 and form a deviated wellbore 102 along a predetermined path through the formation 106. Typically, an entire wellbore 102 can be drilled through a combination of rotary drilling (with higher ROP, but no control over wellbore trajectory) and slide drilling (with lower ROP, but with control of the wellbore trajectory).

During slide drilling, at least a portion of the BHA 124 and/or the conveyance means 122 slides along a sidewall 103 of the wellbore 102 that is opposite the direction of the downhole toolface 185. Thus, during slide drilling, a reduced amount of drill string weight is transferred to the drill bit 126 because of axial friction between the sidewall 103 of the wellbore 102 and the drill string 120. The reduced WOB results in a reduced axial contact force between the drill bit 126 and the formation 106 being cut by the drill bit 126, resulting in a reduced ROP through the formation 106.

The present disclosure is further directed to various implementations of systems and/or methods for monitoring and controlling slide drilling operations to reduce axial friction between the drill string 120 and the sidewall 103 of the wellbore 102 and, thus, increase or otherwise optimize efficiency (e.g., ROP) of slide drilling operations through the formation 106. The systems and/or methods within the scope of the present disclosure may be utilized to monitor (i.e., measure) and control operational parameters of the top drive 116 based on predetermined operational set-points. For example, the systems and/or methods within the scope of the present disclosure may cause the top drive 116 to rotate the drill string 120 in alternating (i.e., opposite) rotational directions in an oscillating manner to lower the axial friction between the drill string 120 and the sidewall 103 of the wellbore 102, thereby increasing weight transfer to the drill bit 126, resulting in a higher ROP, while also controlling directional orientation of the downhole toolface 185.

Figure 2:
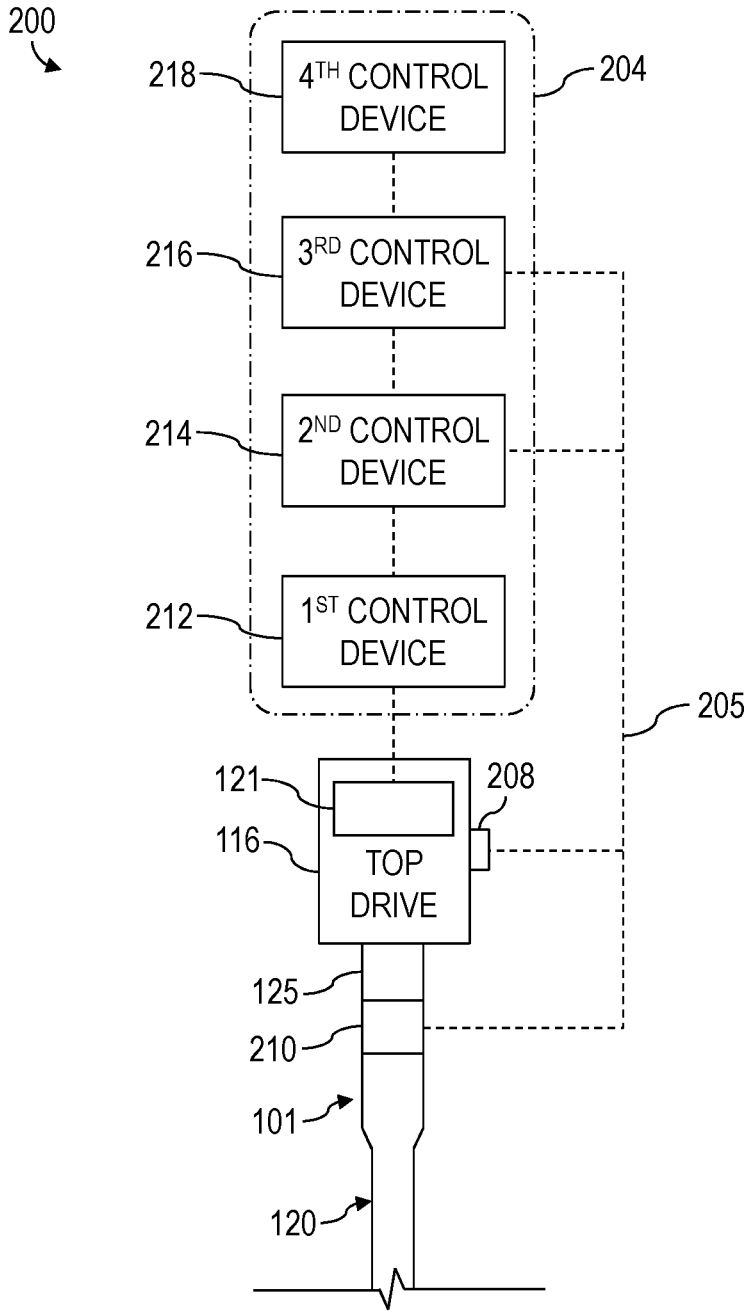
FIG. 2 is a schematic view of at least a portion of an example implementation of apparatus according to one or more aspects of the present disclosure.

FIG. 2 is a schematic view of at least a portion of an example implementation of a control system 200 for monitoring and controlling operation of a top drive 116 to perform or otherwise during slide drilling operations according to one or more aspects of the present disclosure. The control system 200 may be utilized to monitor and control operation of the top drive 116, namely, the electric motor 206 operatively connected to the drive shaft 125, so as to control the speed and azimuth of the drive shaft 125. The control system 200 may form a portion of or operate in conjunction with the well construction system 100 shown in FIG. 1 and, thus, may comprise one or more features of the well construction system 100 shown in FIG. 1, including where indicated by the same reference numerals. Accordingly, the following description refers to FIGS. 1 and 2, collectively.

The control system 200 may comprise one or more control devices 204 (e.g., information processing devices), such as, for example, variable frequency drives (VFDs), programmable logic controllers (PLCs), computers (PCs), industrial computers (IPC), or other controllers equipped with control logic. The control devices 204 are communicatively connected with various sensors and actuators of the top drive 116, other components of the control system 200, and/or other components of the well construction system 100. One or more of the control devices 204 may be in real-time communication with such sensors and actuators, such as for monitoring and/or controlling various portions, components, and equipment of the top drive 116. Communication between one or more of the control devices 204 and the sensors and actuators may be via wired and/or wireless communication means 205. A person having ordinary skill in the art will appreciate that such communication means are within the scope of the present disclosure.

The monitoring system 200 may comprise a sensor (or more than one sensor) 208 operatively connected with and/or disposed in association with the top drive 116. The rotation sensor 208 may be operable to output or otherwise facilitate rotational position measurements (e.g., sensor signals or information) indicative of or operable to facilitate the determination of rotational (i.e., angular or azimuthal) position of the drive shaft 125 of the top drive 116. The rotation sensor 208 may be communicatively connected with one or more of the control devices 204 for transmitting the rotational position measurements to one or more of the control devices 204. The rotation sensor 208 may be disposed or installed in association with, for example, the prime mover 121 to monitor rotational position of the prime mover 121 and, thus, the drive shaft 125. The rotation sensor 208 may be disposed or installed in association with, for example, a rotating member of the gear box to monitor rotational position of the rotating member and, thus, the drive shaft 125. The rotation sensor 208 may be disposed or installed in direct association with, for example, the drive shaft 125 to monitor rotational position of the drive shaft 125. The rotational position measurements may be further indicative of rotational distance (e.g., rotational angle, number of rotations), rotational speed (e.g., revolutions per minute (RPM)), and rotational acceleration of the prime mover 121 and/or the drive shaft 125. The rotation sensor 208 may be or comprise an encoder, a rotary potentiometer, and/or a rotary variable-differential transformer (RVDT), among other examples.

The monitoring system 200 may further comprise one or more electrical devices, each operable to output or otherwise facilitate torque measurements (e.g., signals or information) indicative of or operable to facilitate determination of torque output by the top drive 116. For example, the monitoring system 200 may comprise a torque sensor 210 (e.g., a torque sub) operable to output or otherwise facilitate torque measurements (e.g., signals or information) indicative of or operable to facilitate determination of torque applied by the top drive 116 to the drill string upper end 101. The torque sensor 210 may be communicatively connected with one or more of the control devices 204 for transmitting the torque measurements to one or more of the control devices 204. The torque sensor 210 may be mechanically connected or otherwise disposed between the drive shaft 125 and the drill string upper end 101, such as may permit the torque sensor 210 to transfer and measure torque. The torque sensor 210 and/or other sensors may also facilitate determination of rotational position, rotational distance, rotational speed, and rotational acceleration of the drive shaft 125.

The control devices 204 may be divided into or otherwise comprise hierarchical control levels or layers. A first control level may comprise a first control device 212 (i.e., an actuator control device), such as, for example, a VFD operable to directly power and control (i.e., drive) the prime mover 121 of the top drive 116. The first control device 212 may be electrically connected with the prime mover 121 and/or supported by or disposed in close association with the top drive 116. The first control device 212 may be operable to control operation (e.g., rotational speed and torque) of the prime mover 121 and, thus, the drive shaft 125 of the top drive 116. The first control device 212 may control electrical power (e.g., current, voltage, frequency, etc.) delivered to the prime mover 121. The first control device 212 may be further operable to calculate or determine torque and/or rotational speed generated or output by the prime mover 121, such as based on the electrical power (e.g., current, voltage, frequency, etc.) delivered to the prime mover 121. The first control device 212 may thus be operable to output or otherwise facilitate torque measurements (e.g., signals or information) indicative of or operable to facilitate determination of torque output to the drill string 120 by the top drive 116. The first control device 212 may be communicatively connected with one or more of the other control devices 204 for transmitting the torque measurements to one or more of the other control devices 204. The first control device 212 may be further operable to output or otherwise facilitate rotational speed and/or acceleration measurements indicative of or operable to facilitate determination of operating speed and/or acceleration of the top drive 116.

A second control level may comprise a second control device 214 (e.g., a direct or local control device), such as, for example, a PLC operable to control the prime mover 121 of the top drive 116 via the first control device 212. The second control device 214 may be imparted with and operable to execute program code instructions, such as rigid computer programing. The second control device 214 may be a local control device disposed in association with the top drive 116 or another portion of the drill string drive system of the well construction system 100 and operable to control the top drive 116 and/or other portions of the drill string drive system. The second control device 214 may be communicatively connected with the first control device 212, may be operable to receive torque and other measurements from the first control device 212, and may output control signals or information to the first control device 212 to control the rotational position, rotational distance, rotational speed, and/or torque of the prime mover 121. The second control device 214 may be communicatively connected with the rotation sensor 208 and may be operable to receive rotational position, rotational distance, rotational speed, and/or rotational acceleration measurements output by the rotation sensor 208. The second control device 214 may be communicatively connected with the torque sensor 210 and may be operable to receive the torque and other measurements output by the torque sensor 210. The second control device 214 may have or operate at a sampling rate between about ten hertz (Hz) and about one kilohertz (kHz).

A third control level may comprise a third control device 216 (e.g., a coordinated or central control device), such as, for example, a PC, an IPC, and/or another processing device. The third control device 216 may be imparted with and operable to execute program code instructions, including high-level programming languages, such as C and C++, among other examples, and may be used with program code instructions running in a real-time operating system (RTOS). The third control device 216 may be a system-wide control device operable to control a plurality of devices and/or subsystems of the well construction system 100. The third control device 216 may be or form at least a portion of the processing device 192 shown in FIG. 1. The third control device 216 may be operable to control the prime mover 121 of the top drive 116 via the first and second control devices 212, 214. The third control device 216 may be communicatively connected with the second control device 214 and may be operable to receive torque and other measurements from the first control device 212 via the second control device 214. The third control device 216 may be operable to output control signals or information to the first control device 212 via the second control device 214 to control the rotational position, rotational distance, rotational speed, and/or torque of the prime mover 121. The third control device 216 may be communicatively connected with the rotation sensor 208 and may be operable to receive rotational position, rotational distance, rotational speed, and/or rotational acceleration measurements output by the rotation sensor 208. The third control device 216 may be communicatively connected with the torque sensor 210 and may be operable to receive the torque and other measurements output by the torque sensor 210. The third control device 216 may have or operate at a sampling rate between about ten Hz and about 100 Hz.

A fourth control level may comprise a fourth control device 218 (e.g., an orchestration or supervisory control device), such as, for example, a PC, an IPC, and/or another processing device. The fourth control device 218 may be imparted with and operable to execute program code instructions, including supervisory software for high-level control of the drilling operations of the well construction system 100. The fourth control device 218 may be or form at least a portion of the processing device 192 shown in FIG. 1. The fourth control device 218 may be operable to control the prime mover 121 of the top drive 116 via the first, second, and third control devices 212, 214, 216. The fourth control device 218 may be communicatively connected with the third control device 214 and may be operable to receive torque and other measurements from the first control device 212 via the second and third control devices 214, 216. The fourth control device 218 may be operable to output control signals or information to the first control device 212 via the second and third control devices 214, 216 to control the rotational position, rotational distance, rotational speed, and/or torque of the prime mover 121. The fourth control device 218 may have or operate at a sampling rate ranging from about one or several seconds to about one or several minutes.

Figure 3:
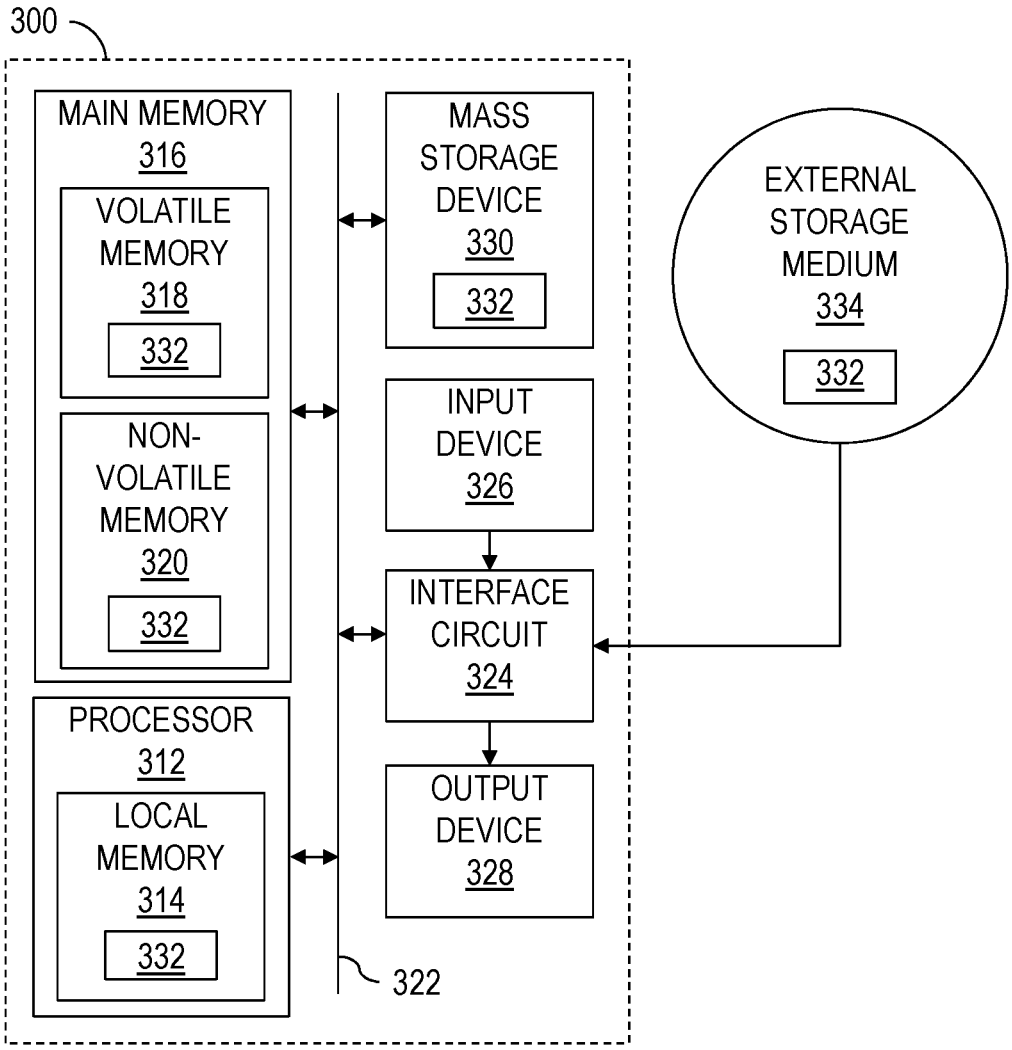
FIG. 3 is a schematic view of at least a portion of an example implementation of apparatus according to one or more aspects of the present disclosure.

FIG. 3 is a schematic view of at least a portion of an example implementation of a processing system 300 (or device) according to one or more aspects of the present disclosure. The processing system 300 may be or form at least a portion of one or more processing devices, equipment controllers, and/or other electronic devices shown in one or more of FIGS. 1 and 2. Accordingly, the following description refers to FIGS. 1-3, collectively.

The processing system 300 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing system 300 may be or form at least a portion of one or more of the processing devices 192, 187 shown in FIG. 1 and/or the control devices 212, 214, 216, 218 shown in FIG. 2. Although it is possible that the entirety of the processing system 300 is implemented within one device, it is also contemplated that one or more components or functions of the processing system 300 may be implemented across multiple devices, some or an entirety of which may be at the wellsite and/or remote from the wellsite.

The processing system 300 may comprise a processor 312, such as a general-purpose programmable processor. The processor 312 may comprise a local memory 314 and may execute machine-readable and executable program code instructions 332 (i.e., computer program code) present in the local memory 314 and/or another memory device. The processor 312 may execute, among other things, the program code instructions 332 and/or other instructions and/or programs to implement the example methods, processes, and/or operations described herein. For example, the program code instructions 332, when executed by the processor 312 of the processing system 300, may cause a top drive 116 to perform example methods and/or operations described herein. The program code instructions 332, when executed by the processor 312 of the processing system 300, may also or instead cause the processor 312 to receive and process sensor data (e.g., sensor measurements) and output control commands for controlling the prime mover 121 of the top drive 116 based on predetermined set-points and the received sensor data.

The processor 312 may be, comprise, or be implemented by one or more processors of various types suitable to the local application environment, such as one or more general-purpose computers, special-purpose computers, microprocessors, digital signal processors (DSPs), field-programmable gate arrays (FPGAs), application-specific integrated circuits (ASICs), and/or processors based on a multi-core processor architecture, as non-limiting examples. Examples of the processor 312 include one or more INTEL microprocessors, microcontrollers from the ARM and/or PICO families of microcontrollers, and/or embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random access memory (RAM), static RAM (SRAM), dynamic RAM (DRAM), synchronous DRAM (SDRAM), RAMBUS DRAM (RDRAM), concurrent RDRAM (CRDRAM), direct RDRAM (DRDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing system 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third-generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing system 300 may be in communication with various sensors, video cameras, actuators, processing devices, equipment controllers, and other devices of the well construction system via the interface circuit 324. The interface circuit 324 can facilitate communications between the processing system 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a fieldbus communication protocol (such as PROFIBUS, Canbus, etc.), a proprietary communication protocol, and/or another communication protocol.

One or more input devices 326 may also be connected to the interface circuit 324. The input devices 326 may permit human wellsite operators 195 to enter the program code instructions 332, which may be or comprise control commands, operational parameters, operational thresholds, and/or other operational set-points. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a trackpad, a trackball, and/or a voice recognition system, among other examples. One or more output devices 328 may also be connected to the interface circuit 324. The output devices 328 may permit visualization or other sensory perception of various data, such as sensor data, status data, and/or other example data. The output devices 328 may be, comprise, or be implemented by video output devices (e.g., a liquid-crystal display (LCD), a light-emitting diode (LED) display, a cathode-ray tube (CRT) display, a touchscreen, etc.), printers, and/or speakers, among other examples. The one or more input devices 326 and/or the one or more output devices 328 connected to the interface circuit 324 may, at least in part, facilitate the HMIs described herein.

The processing system 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, a digital versatile disk (DVD) drive, and/or a flash drive, among other examples. The processing system 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 and other data (e.g., sensor data or measurements database) may be stored in the mass storage device 330, the main memory 316, the local memory 314, and/or the removable storage medium 334. Thus, the processing system 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

The present disclosure is further directed to example methods (e.g., operations and/or processes) for use while performing slide drilling operations via a drill string driver, such as rotary table or top drive. The methods may be performed by utilizing (or otherwise in conjunction with) at least a portion of one or more implementations of one or more instances of the apparatus shown in one or more of FIGS. 1-3, and/or otherwise within the scope of the present disclosure. The methods may be caused to be performed, at least partially, by a processing device, such as the processing device 300 executing program code instructions 332 according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be caused to be performed, at least partially, by a human wellsite operator utilizing one or more instances of the apparatus shown in one or more of FIGS. 1-3, and/or otherwise within the scope of the present disclosure. Thus, the following description of example methods refer to apparatus shown in one or more of FIGS. 1-3. However, the methods may also be performed in conjunction with implementations of apparatus other than those depicted in FIGS. 1-3 that are also within the scope of the present disclosure.

An example method according to one or more aspects of the present disclosure may comprise calibrating, selecting, or otherwise determining optimal operational parameters (i.e., characteristics) of rotational (i.e., angular) motion of the top drive 116, including operational parameters of rotational oscillations imparted to drill string upper end 101 by the top drive 116 in alternating clockwise and counterclockwise directions to optimize transfer of the axial load of the drill string 120 to the bottom of the wellbore 102 and thus optimize efficiency (e.g., ROP) of slide drilling operations. For the sake of clarity and ease of understanding, the methods introduced below are described in the context of a top drive implementation, it being understood that the methods are also applicable to or readily adaptable for use with a rotary table instead or in addition to the top drive.

The method may comprise determining various rotational motion parameters of the top drive 116, such as rotational orientation of the downhole toolface 185, rotational speed of the drive shaft 125, level of torque imparted by the top drive 116 to the drill string 120, and rotational distance of rotational oscillations imparted by the top drive 116 to the drill string upper end 101. A rotational distance of a rotational oscillation may comprise or be defined as a total or cumulative rotational distance (e.g., total or cumulative rotational angle, amplitude, or number of rotations) imparted to the drill string upper end 101 by the top drive 116 in the clockwise or counterclockwise direction.

An example method according to one or more aspects of the present disclosure may comprise determining a reference rotational distance of rotational oscillations that are to be imparted to the drill string upper end 101 by the top drive 116 in alternating clockwise and counterclockwise directions during slide drilling operations. The reference rotational distance may be or comprise total or cumulative rotational distance, imparted to the drill string upper end 101 by the top drive 116 in alternating clockwise and counterclockwise directions, that is sufficient to rotate the entire drill string 120. The reference rotational distance may be implemented during slide drilling operations to optimize efficiency of the slide drilling operations, but without changing orientation of the downhole toolface 185 and thus direction of penetration through the formation 106. The reference rotational distance may then be utilized as a basis for determining another rotational distance (e.g., a base rotational distance) of rotational oscillations that may be imparted to the drill string upper end 101 to perform the slide drilling operations.

The reference rotational distance may be determined via actions performed by various portions of the well construction system 100. Such actions may include, for example, initiating flow of drilling fluid through the drill string 120 without rotating the drill string 120 with the top drive 116. Thereafter, rotation of the drill string 120 may be initiated via the top drive 116 at a relatively low rotational speed (e.g., between about 10 RPM and about 50 RPM) while the drill string 120 is not in contact with the bottom end of the wellbore 102 ("off-bottom"). While the drill string 120 is rotating, torque imparted (actually applied) to the drill string upper end 101 by the drive shaft 125 (or an intervening member), as opposed to the torque output by the prime mover 121, may be measured. The corresponding rotational distance achieved by the drive shaft 125 may also be measured. The torque applied to the drill string upper end 101 may be referred to hereinafter as "drill string torque." While the drill string torque progressively accelerates the drill string 120 from the upper end 101 to the drill bit 126, the drill string torque progressively increases. The drill string torque decreases or remains substantially constant (i.e., unchanged) when the entire drill string 120 starts to rotate. The rotational distance at which the maximum drill string torque is achieved during this acceleration may be deemed as the reference rotational distance.

Figure 4:
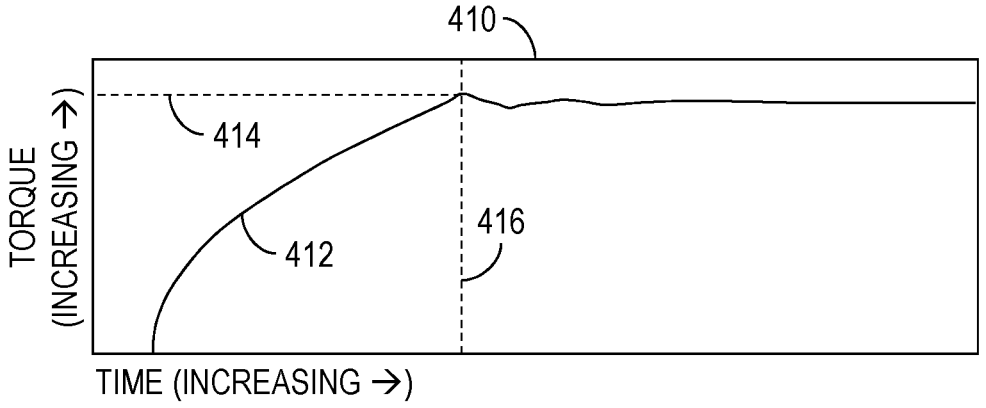
FIGS. 4-12 are graphs related to one or more aspects of the present disclosure.
Figure 5:
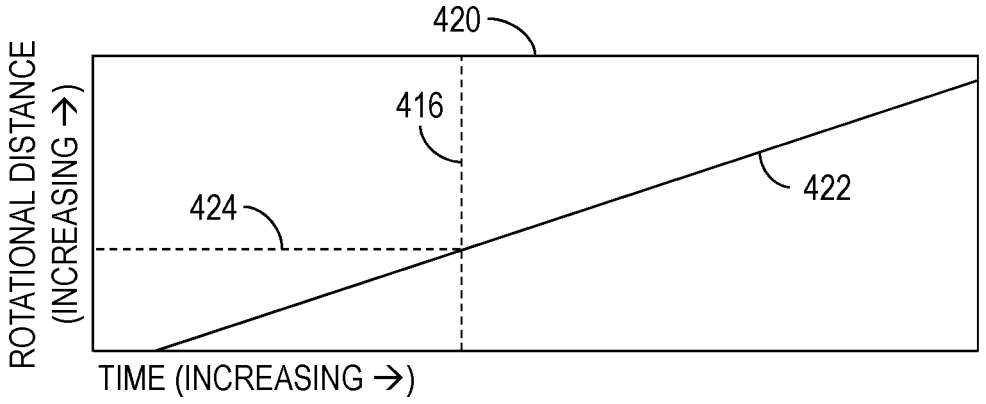
Figure 6:
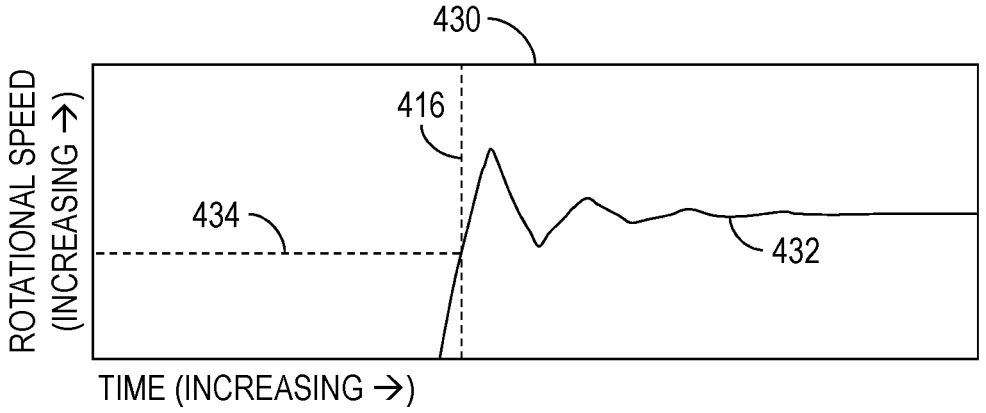

FIGS. 4-6 are graphs 410, 420, 430, respectively, each showing measurements of corresponding operational parameters of selected portions of the well construction system 100 recorded over time while performing the example actions described above. The graphs 410, 420, 430 may be generated by a processing device, such as the processing device 300 shown in FIG. 3 or one or more of the control devices 204 shown in FIG. 2, based on sensor measurements generated or otherwise facilitated by one or more sensors 188, 208, 210 and/or the control device 212 shown in FIGS. 1 and 2.

The graph 410 of FIG. 4 depicts an example drill string torque 412, with respect to time, that may be imparted to the drill string upper end 101 via the drive shaft 125 of the top drive 116. The drill string torque 412 may be determined by calculating torque output by the prime mover 121 of the top drive 116, referred to hereinafter as "top drive torque," and then adjusting the top drive torque based on mechanical properties of the top drive 116. The top drive torque may be measured or otherwise determined based on measurements of electrical current transmitted to the prime mover 121 by a VFD (e.g., the first control device 212) of the top drive 116. The drill string torque may be determined, for example, by utilizing Equation (1) set forth below.

$$T_{ds}=T_{td}-J_{td}\alpha_{td} \tag{1}$$

where $T_{ds}$ is the drill string torque, $T_{td}$ is the top drive torque output by the prime mover 121 of the top drive 116, $J_{td}$ is the rotational inertia of the top drive 116, and $\alpha_{td}$ is the rotational acceleration of the drive shaft 125. The rotational acceleration $\alpha_{td}$ may be determined by utilizing Equation (2) set forth below.

$$\alpha_{td} = \frac{\omega_2 - \omega_1}{dt} \tag{2}$$

where $\omega_1$ indicates rotational speed of the drive shaft 125 at a first time, $\omega_t$ indicates rotational speed of the drive shaft 125 at a subsequent second time, and dt indicates the time interval between the first and second times. However, if the torque sub 210 is used to determine the drill string torque, then Equations (1) and (2) may be disregarded and the drill string torque $T_{ds}$ may be deemed as being equal to the torque measurements facilitated by the torque sub 210.

The graph 420 of FIG. 5 depicts an example rotational distance 422 (e.g., total or cumulative rotational angle or number of rotations) through which the drive shaft 125 rotates in association with the torque 412 shown in FIG. 4, with respect to the same time scale as depicted FIG. 4. The rotational distance 422 may be measured via a rotation sensor (e.g., the rotation sensor 208) of the top drive 116. The graph 430 of FIG. 6 depicts an example rotational speed 432 of the downhole motor housing 184 in association with the torque 412 shown in FIG. 4 and the rotational distance 422 shown in FIG. 5, with respect to the same time scale as depicted in FIGS. 4 and 5.

The sensor measurements (i.e., signals) indicative of torque 412, rotational distance 422, and/or rotational speed 432 output by one or more of the sensors 188, 208, 210 and the first control device 212 may comprise high frequency noise, which may be filtered out via a low-pass filter before being received, processed, and/or utilized by the processing device. The sensor measurements may be filtered in real-time while the sensor measurements are output, or the sensor measurements may be recorded for a predetermined period of time and then filtered via a zero-phase filtering means. However, other data filtering may also or instead be utilized within the scope of the present disclosure.

The graph 410 shows the drill string torque 412 reaching a maximum 414 at a time 416, indicating that the entire drill string 120 (from the upper end 101 to the drill bit 126) is rotating. In other words, during the period leading up to the time 416, a decreasing portion of the drill string 120 remains stationary in the wellbore 102. For example, the maximum drill string torque 414 may be about 5000 Newton-meters (N-m), and the "full-rotation" time 416 may be about 120 seconds. The graph 420 shows that, at the full-rotation time 416, the drive shaft 125 of the top drive 116 reached a rotational distance 424. For example, this full-rotation rotational distance 424 may be about 630 degrees (or about 1.75 revolutions). The graph 430 shows that, at the full-rotation time 416, the downhole motor housing 184 is rotating at a rotational speed 434 and is accelerating. For example, this full-rotation rotational speed 434 may be about 7.5 RPM.

The maximum drill string torque 414 required to initiate rotation of the entire drill string may be referred to hereinafter as the "reference drill string torque." The full-rotation rotational distance 424 may be or comprise the reference rotational distance described above. In other words, the reference rotational distance is the rotational distance output by the top drive 116 to the drill string upper end 101 that causes the bottom end of the drill string 120 to start rotating. The reference rotational distance may be utilized to scale or otherwise determine a base (or background) rotational distance, which may be implemented during slide drilling operations.

During slide drilling operations, the top drive 116 may impart rotational oscillations (i.e., alternating rotations in clockwise and counterclockwise directions) to the drill string upper end 101, wherein each rotational oscillation is through the base rotational distance. The rotational oscillations through the base rotational distance are configured to maintain the current orientation of the toolface 185, which usually will be at the midpoint of each rotational oscillation. Thus, the toolface 185 (the downhole orientation of the mud motor 184) is not expected to change unless there are changes to the midpoint of the surface oscillations. For example, the base rotational distance may be selected based on the reference rotational distance such that the downhole toolface 185 is maintained substantially static or experiences rotational oscillations that are appreciably less than the base rotational distance, such as 0-5% (or some other predetermined percentage) of the base rotational distance. The base rotational distance may be the reference rotational distance, a portion of the reference rotational distance, or more than the reference rotational distance. For example, the base rotational distance may be about 33% of the reference rotational distance. However, in other implementations within the scope of the present disclosure, the base rotational distance may be 30-35% of the reference rotational distance, 25-40% of the reference rotational distance, 20-50% of the reference rotational distance, 20-60% of the reference rotational distance, or some other predetermined value, range, or function based on the reference rotational distance.

A processing device within the scope of the present disclosure, such as the processing device 300 shown in FIG. 3 or one or more of the control devices 204 (e.g., the control device 214 and/or control device 216) shown in FIG. 2, may be operable to control operation of the top drive 116, and perhaps to determine the reference and base rotational distances. For example, the processing device may be operable to output a control command to the top drive 116 to cause the top drive 116 to rotate the drill string 120 while off-bottom. The processing device may also receive torque measurements, such as the time-based torque 412 shown in FIG. 4, and perhaps rotation/position measurements, such as the time-based rotational distance 422 shown in FIG. 5. If the rotation/position measurements received by the processing device do not include the time-based rotation distance 422, the processing device may determine the time-based rotational distance 422 based on the rotation/position measurements that are received. The processing device may also determine the reference rotational distance 424 that corresponds to the maximum torque 414, as well as the base rotational distance based on the reference rotational distance 424. During the slide drilling operations, the processing device may also output control commands to the top drive 116 to cause the top drive 116 to rotationally oscillate the drill string 120 in alternating opposing directions through the base rotational distance.

The processing device may receive the torque measurements from the torque sensor 208 and/or the torque sub 210. The processing device may also or instead receive the torque measurements from a VFD or other control device 212 driving the prime mover 121 of the top drive 116. The processing device may also determine the level of torque that is applied to the drill string 120 by the top drive 116 by utilizing Equation (1) set forth above, where $T_{td}$ is the torque of the top drive 116 indicated by the torque measurements output by the VFD or other control device 212.

Instead of performing actual downhole operations described above, or in addition thereto, the reference and base rotational distances may be determined by mathematically modeling the drill string 120 and mathematically calculating the rotational distance of the top drive 116 at the maximum drill string torque. The mathematical model may be a computer-generated static or dynamic model, which can use or be based on data from a current well or offset wells to calibrate input parameters (e.g., friction coefficient between the drill string 120 and the wellbore 102).

The base rotational distance may be changed (e.g., increased or decreased) depending on the downhole toolface orientation 185. For example, if the downhole toolface orientation 185 changes more than an intended amount during slide drilling, such as if the toolface 185 oscillates by a few azimuthal degrees on either side of the intended toolface 185, the processing device and/or a wellsite operator 195 may decrease the base rotational distance to a smaller fraction of the reference rotational distance. Furthermore, to steer the slide drilling operation, the toolface 185 may be changed by altering one (or more) of the top drive oscillations through the base rotational distance. For example, rotating the downhole toolface 185 in the clockwise direction may include increasing the base rotational distance of one or more clockwise oscillations and/or decreasing the base rotational distance of one or more counterclockwise oscillations. While slide drilling, the processing device or the wellsite operator may also compensate for other drilling parameters. For example, the base rotational distance of the rotational oscillations may be modified depending on measured values of hook load and/or standpipe pressure (e.g., relative to an off-bottom reference).

The present disclosure introduces an example method comprising changing the toolface 185 by temporarily changing the base rotational distance. During slide drilling operations, the top drive 116 imparts rotational oscillations alternatingly in opposing clockwise and counterclockwise directions to the upper end 101 of the drill string 120. During each rotational oscillation, the top drive 166 may rotate the drill string upper end 101 by a rotational distance that optimizes (e.g., maximizes) the transfer of axial load of the drill string 120 to the bottom of the wellbore 102 and thus optimizes efficiency of the slide drilling operation. That rotational distance is referred to hereinafter as "an optimal rotational distance." The optimal rotational distance may be determined by adjusting the reference rotational distance by different fractions until an optimal fraction and thus optimal rotational distance is determined.

For example, an average pattern of rotational oscillations imparted to the drill string 120 during slide drilling operations may be denoted as [$+\Theta_b$; $-\Theta_b$; $+\Theta_b$; $-\Theta_b$; $+\Theta_b$; $-\Theta_b$; . . . ], corresponding to the top drive 116 rotating the drill string upper end 101 alternatingly in opposing clockwise (+) and counterclockwise (−) directions by a base rotational distance $\Theta_b$. The intended change to the downhole toolface 185 may be implemented by adding an offset rotational distance $\Theta_\Delta$ to one instance of the base rotational distances $\Theta_b$, resulting in a pattern of [$+\Theta_b$; $-\Theta_b$; $+\Theta_b+\Theta_\Delta$; $-\Theta_b$; $+\Theta_b$; $-\Theta_b$; . . . ], thereby causing the downhole toolface 185 to change in the clockwise direction by the offset rotational distance $\Theta_\Delta$. However, such change to the toolface 185 may take a relatively long period of time (e.g., tens of seconds to several minutes), depending on the length of the drill string 120.

The intended change may be accelerated by further adding an overshoot rotational distance $\Theta_{os}$ to the instance of the base rotational distance $\Theta_b$ to which the offset rotational distance $\Theta_\Delta$ was added. The overshoot rotational distance $\Theta_{os}$ may then be added to the base rotational distance $\Theta_b$ of a subsequent instance of the rotational oscillations rotating in an opposing direction from the previous instance of the rotational oscillations to which the overshoot rotational distance $\Theta_{os}$ was added, to compensate for (or subtract) the previously added overshoot rotational distance $\Theta_{os}$. The resulting pattern of rotational oscillations imparted to the drill string during slide drilling operations may be denoted, for example, as [$+\Theta_b$; $-\Theta_b$; $+\Theta_b+\Theta_\Delta+\Theta_{os}$; $-\Theta_b-\Theta_{os}$; $+\Theta_b$; $-\Theta_b$; . . . ].

An optimal overshoot rotational distance $\Theta_{os}$, such as one that causes the offset rotational distance $\Theta_\Delta$ to be achieved in the shortest amount of time, may be determined by temporarily adding different overshoot rotational distances $\Theta_{os}$, to the base rotational distance $\Theta_b$ and the offset rotational distance $\Theta_\Delta$ of a rotational oscillation during slide drilling operations and measuring the downhole toolface orientation to determine when the downhole toolface orientation reaches the offset rotational distance.

Figure 7:
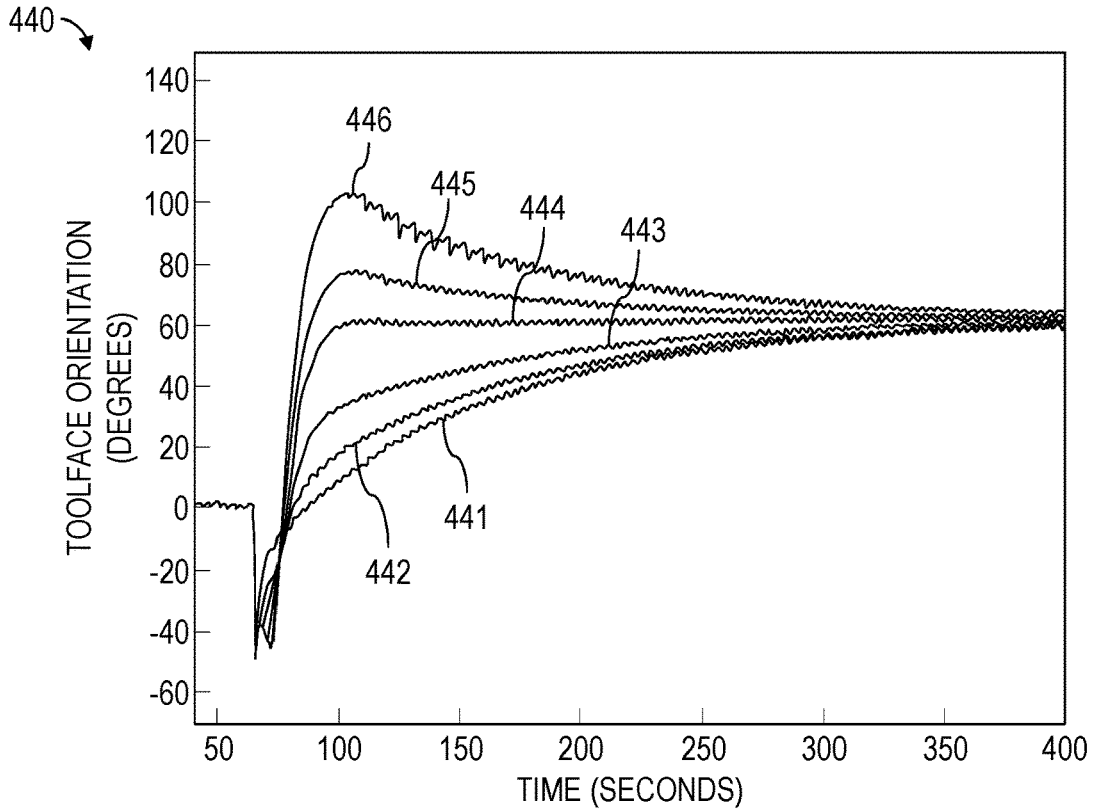

FIG. 7 is a graph 440 showing example, simulated downhole toolface orientation measurements 441-446 recorded over time for different overshoot rotational distances, which may be used to determine an optimal overshoot rotational distance. The downhole toolface orientation measurements 441-446 are based on tests performed on a drill string. The graph 440 may be generated by a processing device, such as the processing device 300 shown in FIG. 3 or one or more of the control devices 204 shown in FIG. 2, based on sensor measurements generated or otherwise facilitated by one or more downhole sensors 188 shown in FIGS. 1 and 2.

Each of the downhole toolface orientation measurements 441-446 are associated with a drill string that is being imparted with rotational oscillations having a base rotational distance $\Theta_b$ of 210 degrees and is attempting to change the downhole toolface orientation by an offset rotational distance $\Theta_\Delta$ of 60 degrees, thereby shifting from an initial downhole toolface orientation of zero degrees to a target (or intended) downhole toolface orientation of 60 degrees. The downhole toolface orientation measurements 441 depict changing the toolface without utilizing an overshoot rotational distance $\Theta_{os}$, whereas the downhole toolface orientation measurements 442, 443, 444, 445, and 446 depict utilizing an overshoot rotational distance $\Theta_{os}$ of 120 degrees, 210 degrees, 312 degrees, 360 degrees, and 420 degrees, respectively. The graph 440 shows the downhole toolface orientation measurements 441, 442, 443 approaching the target downhole toolface orientation of 60 degrees at a slow rate, each reaching an asymptotic value of 60 degrees after about 300 to 350 seconds. The graph 440 further shows the downhole toolface orientation measurements 445, 446 overshoot the target downhole toolface orientation of 60 degrees and then reach an asymptotic value of 60 degrees after about 400 seconds. The graph 440 also shows the downhole toolface orientation measurements 444 quickly approaching, but not overshooting, the target downhole toolface orientation of 60 degrees, and reaching an asymptotic value of 60 degrees after about 100 seconds. Because the target downhole toolface orientation of 60 degrees was reached in the shortest amount of time when temporarily adding an overshoot rotational distance of 312 degrees, such overshoot rotational distance may be deemed as the optimal overshoot rotational distance.

While slide drilling, the processing device or the wellsite operator may also compensate for other drilling parameters. For example, the overshoot rotational distance may be modified depending on measured values of hook load and/or standpipe pressure. If the target downhole toolface orientation (or an intended offset rotational distance) is to the left (opposite the direction of bit rotation), the ROP, weight on bit (WOB), and torque on bit (TOB) may be increased to reach such target downhole toolface orientation. Amplitude of the offset rotational distance to reach the target downhole toolface orientation can be predicted, such as by relating the increase in standpipe pressure to an increase in TOB, which can be accomplished through calibrations while drilling or from a mud motor specification sheet. The downhole toolface change from a given increase in TOB may asymptotically approach the increase in torque, multiplied by torsional compliance of the entire drill string. The torsional compliance can be estimated by knowledge of the drill string geometry and material properties. Thus, an intended downhole toolface orientation change may be performed by controlling the increase in standpipe pressure.

The sum of the offset rotational distance and the overshoot rotational distance is proportional to (i.e., scales linearly with) or is otherwise related to the length of the drill string. Thus, the amplitude of the overshoot rotational distance added to the offset rotational distance to change the downhole toolface orientation is a function of or otherwise depends on the amplitude of the offset rotational distance and the length of the drill string. Accordingly, the sum of the offset rotational distance and the overshoot rotational distance by which the base rotational distance is to be temporarily changed to achieve the intended offset rotational distance may be predicted based on the length of the drill string.

Figure 8:
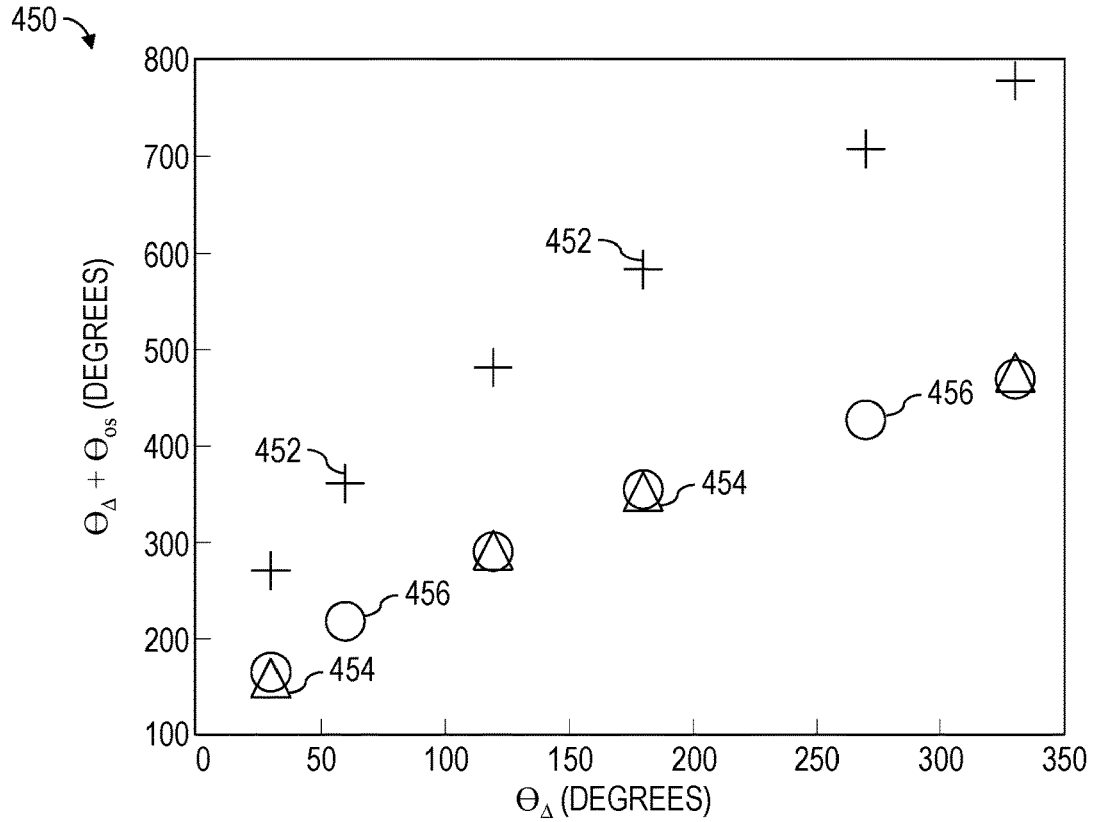

FIG. 8 is a graph 450 showing the sum of example, simulated offset rotational distances $\Theta_\Delta$ and example, simulated overshoot rotational distances $\Theta_{os}$, plotted along the vertical axis, related by a coefficient or factor to example offset rotational distances $\Theta_\Delta$ by which the downhole toolface orientation is to be changed, plotted along the horizontal axis. The relationship shown in graph 450 is based on simulations performed on a first drill string, having a length of 1500 meters (m), and a second drill string having a length of 2500 m. Such simulations may include the simulations described above in association with FIG. 7. The graph 450 simulates what may be generated by a processing device, such as the processing device 300 shown in FIG. 3 or one or more of the control devices 204 shown in FIG. 2, based on sensor measurements generated or otherwise facilitated by one or more sensors 188, 208, 210 shown in FIGS. 1 and 2.

The crosses 452 in the graph 450 indicate optimal values of the sum of the offset rotational distance $\Theta_\Delta$ and the overshoot rotational distance $\Theta_{os}$ for the second drill string for corresponding offset rotational distances. The triangles 454 in the graph 450 indicate optimal values of the sum of the offset rotational distance $\Theta_\Delta$ and the overshoot rotational distance $\Theta_{os}$ for the first drill string for corresponding offset rotational distances. The circles in the graph 450 indicate optimal values of the sum of the offset rotational distance $\Theta_\Delta$ and the overshoot rotational distance $\Theta_{os}$ for the second drill string that are scaled by a factor of ⅗ (0.60), which is the ratio of the lengths (1500 m/2500 m) of the drill strings. The triangles 454 and the circles 456 closely match or are otherwise substantially similar, indicating a simple linear relationship between the sum of the offset rotational distance and overshoot rotational distance and the rotational distances based on the length of the drill string. Thus, an overshoot rotational distance may be predicted based on the offset rotational distance and the length of the drill string. Such rotational distance to drill string length relationships (e.g., coefficients or factors) may be encapsulated in a lookup table or curve-fit, which may be used to determine an optimal overshoot rotational distance of a drill string based on the offset rotational distance and the length of a current drill string by simply scaling results of previously performed tests and/or simulations (e.g., such as the simulations described above in association with FIG. 7) to match the length of the current drill string to determine the optimal overshoot rotational distance, without having to perform such tests on the drill string.

The present disclosure is further directed to example methods of determining when a downhole toolface orientation changes by an intended offset rotational distance (or reaches the target downhole toolface orientation) based on drill string torque measurements. Typically, sensor signals or measurements indicative of downhole toolface orientation can be transmitted to the surface via a mud-pulse or other telemetry system. Such telemetry systems provide infrequent updates of downhole toolface orientation to the surface (e.g., every 30 seconds or longer in deeper wells). The updates can also be delayed (e.g., by tens of seconds) relative to when the actual measurement was taken downhole. As described above, the process to reach the offset rotational distance may take tens to hundreds of seconds. Thus, at any given time during slide drilling operations, a surface controller or a human wellsite operator will not know if the offset rotational distance has been reached. However, measurements of drill string torque can be used to determine if the offset rotational distance has been reached without relying of a downhole telemetry system.

For example, if drill string torque is applied to the upper end of the drill string in a constant or unchanging oscillating manner, the corresponding drill string torque measurements may also have an oscillating pattern with a constant or unchanging average torque value when averaged over an oscillation cycle. However, when a change is made to the drill string torque applied to the upper end of the drill string, such as when an offset rotational distance and/or an overshoot rotational distance are added to a base rotational distance of a rotational oscillation to attempt to change the downhole toolface orientation, the drill string torque measurements may show a transient or changing oscillating pattern. However, when the torque oscillations return to having a regular oscillating pattern, the drill string torque measurements will also return to the constant oscillating pattern having a constant or unchanging average torque value. Such return of drill string torque to its previous constant oscillating pattern coincides with the time when the downhole toolface reaches an asymptotic value of the offset rotational distance.

Figure 9:
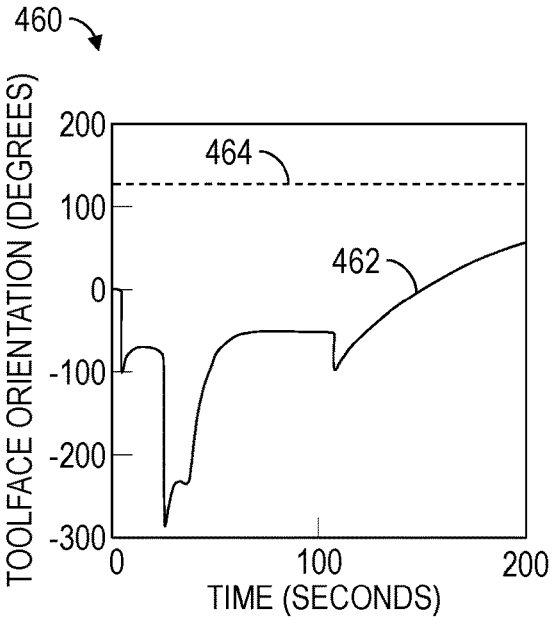
Figure 10:
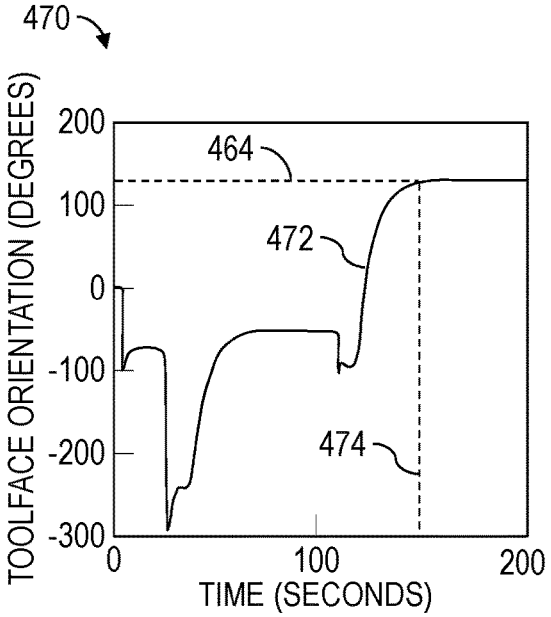
Figure 11:
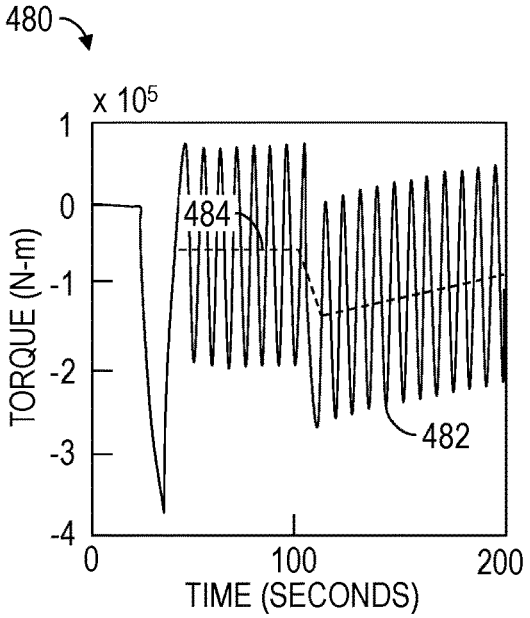
Figure 12:
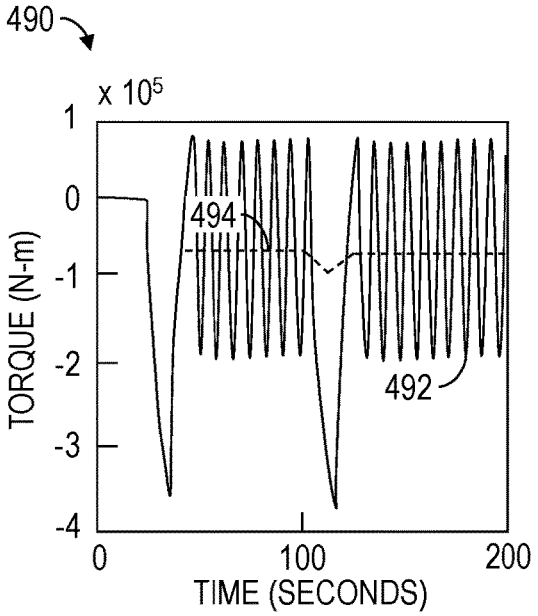

Therefore, a processing device within the scope of the present disclosure may determine when the downhole toolface orientation changes by the offset rotational distance (or reaches the target downhole toolface orientation) based on drill string torque measurements captured after the offset rotational distance was added to the base rotational distance during slide drilling operations. A changing average value of the drill string torque measurements may be indicative that the downhole toolface orientation is changing and therefore did not yet change by the offset rotational distance, and a substantially constant average value of the drill string torque measurements may be indicative that the downhole toolface orientation is not changing and therefore changed by the offset rotational distance FIGS. 9 and 10 are graphs 460, 470, respectively, each showing downhole toolface orientation during slide drilling operations recorded over time while performing example method steps or actions described above to change the downhole toolface orientation. The downhole toolface orientation is shown plotted along the vertical axis, with respect to time, which is shown plotted along the horizontal axis. FIGS. 11 and 12 are graphs 480, 490, respectively, each showing drill string torque recorded over time while changing the downhole toolface orientation. The graphs 460, 470, 480, 490 may each be generated by a processing device, such as the processing device 300 shown in FIG. 3 or one or more of the control devices 204 shown in FIG. 2, based on sensor measurements generated or otherwise facilitated by one or more sensors 188, 208, 210 and/or control devices 212 shown in FIG. 2. Accordingly, the following description refers to FIGS. 1-3 and 9-12, collectively.

Graphs 460, 470 each show downhole toolface orientation measurements 462, 472, respectively, while attempting to change downhole toolface orientation from −50 degrees to a target downhole toolface orientation 464 of 130 degrees, by introducing an offset rotational distance of 180 degrees at a time of about 100 seconds to an instance of the background rotational oscillations imparted to the upper end of the drill string by a top drive. Graph 480 shows drill string torque measurements 482 while attempting to change the downhole toolface orientation as shown in graph 460, and graph 490 shows drill string torque measurements 492 while attempting to change the downhole toolface orientation as shown in graph 470.

Graph 460 shows an attempt to change downhole toolface orientation when no overshoot rotational distance (or a low overshoot rotational distance) was added to the background rotational oscillations, resulting in the downhole toolface orientation measurements 462 approaching the target downhole toolface orientation 464 of 130 degrees at a slow rate, wherein at a time of 200 seconds the downhole toolface orientation has just changed by about 110 degrees reaching downhole toolface orientation of about 60 degrees. The corresponding graph 470 shows drill string torque measurements 482 having an oscillating torque pattern having an average value 484 that undergoes a sudden shift at a time of about 100 seconds, corresponding to the added offset rotational distance of 180 degrees to the background rotational oscillations in an attempt to change the downhole toolface orientation. While the downhole toolface orientation is changing after a time of 100 seconds, the average value 484 of the oscillating torque is progressively changing (i.e., has a transient oscillating pattern), indicating that the downhole toolface orientation has not achieved an asymptotic value of the offset rotational distance of 180 degrees and is still changing toward the target downhole toolface orientation 464 of 130 degrees.

Graph 470 shows an attempt to change downhole toolface orientation when an optimal overshoot rotational distance (or near optimal overshoot rotational distance) was temporarily added to the background rotational oscillations, resulting in the downhole toolface orientation measurements 462 quickly approaching, but not overshooting, the target downhole toolface orientation 464 of 130 degrees, and reaching an asymptotic value of 60 degrees (the target downhole toolface orientation) after about 50 seconds at a time 474 of about 150 seconds. The corresponding graph 490 shows drill string torque measurements 492 having an oscillating torque pattern and an average value 494 that undergoes a sudden shift at a time of about 100 seconds, corresponding to the added offset rotational distance of 180 degrees and the optimal overshoot rotational distance to the background rotational oscillations in an attempt to change the downhole toolface orientation. However, shortly after a time of 100 seconds, the average value 494 of the oscillating torque quickly returns to its previous level and remains substantially constant, indicating that the downhole toolface orientation has achieved an asymptotic value of the offset rotational distance of 180 degrees and is no longer changing toward the target downhole toolface orientation of 130 degrees. In this manner, drill string torque measurements can be used to monitor the state of the downhole toolface orientation change. A sampling rate of drill string torque oscillation frequency ranging between about 10 Hz and about 50 Hz can be used to determine if the oscillating torque pattern and/or average torque value has changed from one cycle to the next.

The present disclosure is further directed to a method integrating or otherwise comprising a plurality of example methods described herein. An example of such method may comprise determining a base (background) rotational distance of base rotational oscillations to be imparted to the upper end of a drill string during slide drilling operations. The base rotational distance may be or comprise an optimal base rotational distance, at which the entire drill string above the downhole toolface rotates. Determining the rotational distance of base rotational oscillations may comprise rotating the drill string off-bottom, determining a reference rotational distance at which maximum drill string torque occurs, and selecting the base rotational distance of rotational oscillations as a fraction of the determined reference rotational distance, as described above in association with FIGS. 4-6. The method may further comprise performing slide drilling operations using the determined base rotational distance while measuring downhole toolface orientation. The method may further comprise comparing the measured downhole toolface orientation with a target downhole toolface orientation to determine (i.e., calculate) an offset rotational distance by which the downhole toolface orientation is to be changed or shifted. The method may further comprise determining an overshoot rotational distance by performing tests on the drill string, as described above in association with FIG. 7, or by using a lookup table or polynomial fit generated via steps described above in association with FIG. 8. The method may also comprise imparting the determined offset rotational distance and temporarily imparting the determined overshoot rotational distance to the base rotational distance of an instance of the rotational oscillations while performing the slide drilling operations, as described above in association with FIGS. 9 and 10, thereby changing an oscillation pattern imparted to the upper end of the drill string by the top drive to quickly change the downhole toolface orientation by the offset rotational distance. The method may also comprise measuring drill string torque to determine if the downhole toolface has reached the offset rotational distance (or the target downhole toolface orientation), as described above in association with FIGS. 11 and 12.

In view of the entirety of the present disclosure, including the figures and the claims, a person having ordinary skill in the art will readily recognize that the present disclosure introduces an apparatus comprising: a top drive configured for connection with an upper end of a drill string; a rotation sensor operable to facilitate rotational distance measurements indicative of rotational distance achieved by the top drive; and a processing device comprising a processor and a memory storing computer program code, wherein the processing device is operable to cause the top drive to: impart rotational oscillations alternatingly in opposing directions to the upper end of the drill string while maintaining a downhole toolface orientation during a slide drilling operation such that each rotational oscillation rotates the upper end of the drill string through a base rotational distance; and change the downhole toolface orientation by an offset rotational distance by adding the offset rotational distance and an overshoot rotational distance to the base rotational distance of an instance of the rotational oscillations.

Adding the overshoot rotational distance may cause the downhole toolface orientation to change faster than when changing the toolface orientation by adding the offset rotational distance but not the overshoot rotational distance.

The overshoot rotational distance may be a function of the offset rotational distance and a length of the drill string.

The instance may be a first instance, the processing device may be operable to cause the top drive to change the downhole toolface orientation by the offset rotational distance by also adding the overshoot rotational distance to the base rotational distance of a second instance of the rotational oscillations; and the first and second instances may be in opposite directions.

The apparatus may further comprise an electrical device operable to facilitate torque measurements indicative of torque applied to the drill string by the top drive, wherein: the processing device may be further operable to determine when the downhole toolface orientation changes by the offset rotational distance based on the torque measurements; a changing average value of the torque measurements may indicate that the downhole toolface orientation is changing and therefore did not yet change by the offset rotational distance; and a substantially constant average value of the torque measurements may indicate that the downhole toolface orientation is not changing and therefore changed by the offset rotational distance. The electrical device may be or comprise at least one of: a torque sensor disposed in association with the top drive; and a VFD driving an electric motor of the top drive.

The apparatus may further comprise an electrical device operable to facilitate torque measurements indicative of torque applied to the drill string by the top drive, wherein before performing the slide drilling operations while the drill string is off-bottom, the processing device may be further operable to determine the base rotational distance based on the rotational distance measurements and the torque measurements. The processing device may be further operable to determine the base rotational distance as being equal to a predetermined fraction of a rotational distance achieved by the top drive at a maximum torque applied to the drill string by the top drive.

The rotation sensor may be or comprise an encoder disposed in association with the top drive.

The present disclosure also introduces a method comprising commencing operation of a processing device communicatively connected to a top drive of a well construction system, wherein the processing device operation causes the top drive to: impart rotational oscillations in alternating opposite directions to an upper end of a drill string while maintaining a downhole toolface orientation during a slide drilling operation, wherein each rotational oscillation is through a base rotational distance; and change the downhole toolface orientation by an offset rotational distance by adding the offset rotational distance and an overshoot rotational distance to the base rotational distance of an instance of the rotational oscillations.

Adding the overshoot rotational distance may cause the downhole toolface orientation to change faster than when changing the toolface orientation by adding just the offset rotational distance and not the overshoot rotational distance.

The overshoot rotational distance may be a function of the offset rotational distance and length of the drill string.

The instance may be a first instance, the processing device operation may cause the top drive to change the downhole toolface orientation by the offset rotational distance by also adding the overshoot rotational distance to the base rotational distance of a second instance of the rotational oscillations, and the first and second instances may be in opposite directions.

The processing device operation may comprise determining when the downhole toolface orientation changes by the offset rotational distance based on measurements of torque applied to the drill string by the top drive. A changing average value of the torque measurements may indicate that the downhole toolface orientation is changing and therefore has not yet changed by the offset rotational distance. A substantially constant average value of the torque measurements may indicate that the downhole toolface orientation is not changing and therefore has changed by the offset rotational distance.

The processing device operation may comprise, before performing the slide drilling operation and while the drill string is off-bottom, determining the base rotational distance based on the rotational distance measurements and torque measurements indicative of torque applied to the drill string by the top drive. Determining the base rotational distance may comprise determining the base rotational distance as being equal to a predetermined fraction of a rotational distance achieved by the top drive at a maximum torque applied to the drill string by the top drive.

The present disclosure also introduces a method comprising commencing operation of a processing device communicatively connected to a well construction system comprising a top drive, wherein the processing device operation causes the top drive to: (A) impart rotational oscillations in alternating first and second opposite directions to an upper end of a drill string while maintaining a downhole toolface orientation during a slide drilling operation, wherein each rotational oscillation is through a base rotational distance; and (B) change the downhole toolface orientation by an offset rotational distance by: (1) adding the offset rotational distance and an overshoot rotational distance to the base rotational distance of an instance of the rotational oscillations in the first direction; and (2) adding the overshoot rotational distance to the base rotational distance of an instance of the rotational oscillations in the second direction.

The processing device operation may comprise determining when the downhole toolface orientation changes by the offset rotational distance based on measurements of torque applied to the drill string by the top drive. A changing average value of the torque measurements may indicate that the downhole toolface orientation is changing and therefore has not yet changed by the offset rotational distance. A substantially constant average value of the torque measurements may indicate that the downhole toolface orientation is not changing and therefore has changed by the offset rotational distance.

The processing device operation may comprise, before performing the slide drilling operation, determining the base rotational distance by, while off-bottom: outputting a command causing the top drive to rotate the drill string; receiving measurement data indicative of torque and corresponding rotation imparted by the top drive in response to the output command; determining a reference rotational distance as being the measured rotation that corresponds to a maximum of the measured torque; and determining the base rotational distance as being a predetermined fraction of the reference rotational distance.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a top drive configured for connection with an upper end of a drill string;

a rotation sensor operable to facilitate rotational distance measurements indicative of rotational distance achieved by the top drive; and a processing device comprising a processor and a memory storing computer program code, wherein the processing device is operable to cause the top drive to:

impart rotational oscillations alternatingly in opposing directions to the upper end of the drill string while maintaining an initial downhole toolface orientation during a slide drilling operation such that each rotational oscillation rotates the upper end of the drill string through a base rotational distance; and change the initial downhole toolface orientation to an intended downhole toolface orientation by adding an offset rotational distance and an overshoot rotational distance to the base rotational distance of an instance of the rotational oscillations, wherein the overshoot rotational distance is determined from the offset rotational distance and a length of the drill string.

2. The apparatus of claim 1 wherein adding the overshoot rotational distance causes the initial downhole toolface orientation to change faster than when changing the initial downhole toolface orientation by adding the offset rotational distance but not the overshoot rotational distance.

3. The apparatus of claim 1 wherein:

the instance is a first instance;

the processing device is operable to cause the top drive to change the initial downhole toolface orientation to the intended downhole toolface orientation by also adding the overshoot rotational distance to the base rotational distance of a second instance of the rotational oscillations; and the first and second instances are in opposite directions.

4. The apparatus of claim 1 further comprising an electrical device operable to facilitate torque measurements indicative of torque applied to the drill string by the top drive, wherein:

the processing device is further operable to determine when the initial downhole toolface orientation changes to the intended downhole toolface orientation based on the torque measurements;

a changing average value of the torque measurements indicates that the initial downhole toolface orientation is changing and therefore did not yet change to the intended downhole toolface orientation; and a substantially constant average value of the torque measurements indicates that the initial downhole toolface orientation has changed to the intended downhole toolface orientation.

5. The apparatus of claim 4 wherein the electrical device is or comprises at least one of:

a torque sensor disposed in association with the top drive; and a variable frequency drive driving an electric motor of the top drive.

6. The apparatus of claim 1 further comprising an electrical device operable to facilitate torque measurements indicative of torque applied to the drill string by the top drive, wherein before performing the slide drilling operations while the drill string is off-bottom, the processing device is further operable to determine the base rotational distance based on the rotational distance measurements and the torque measurements.

7. The apparatus of claim 6 wherein the processing device is further operable to determine the base rotational distance as being equal to a predetermined fraction of a rotational distance achieved by the top drive at a maximum torque applied to the drill string by the top drive.

8. The apparatus of claim 1 wherein the rotation sensor is or comprises an encoder disposed in association with the top drive.

9. A method comprising:

commencing operation of a processing device communicatively connected to a top drive of a well construction system, wherein the processing device operation causes the top drive to:

impart rotational oscillations in alternating opposite directions to an upper end of a drill string while maintaining an initial downhole toolface orientation during a slide drilling operation, wherein each rotational oscillation is through a base rotational distance; and change the initial downhole toolface orientation to an intended downhole toolface orientation by adding an offset rotational distance and an overshoot rotational distance to the base rotational distance of an instance of the rotational oscillations, wherein the overshoot rotational distance is determined from the offset rotational distance and a length of the drill string.

10. The method of claim 9 wherein adding the overshoot rotational distance causes the initial downhole toolface orientation to change faster than when changing the initial downhole toolface orientation by adding just the offset rotational distance and not the overshoot rotational distance.

11. The method of claim 9 wherein:

the instance is a first instance;

the processing device operation causes the top drive to change the initial downhole toolface orientation to the intended downhole toolface orientation by also adding the overshoot rotational distance to the base rotational distance of a second instance of the rotational oscillations; and the first and second instances are in opposite directions.

12. The method of claim 9 wherein the processing device operation comprises determining when the initial downhole toolface orientation changes to the intended downhole toolface orientation based on measurements of torque applied to the drill string by the top drive.

13. The method of claim 12 wherein:

a changing average value of the torque measurements indicates that the initial downhole toolface orientation is changing and therefore has not yet changed to the intended downhole toolface orientation; and a substantially constant average value of the torque measurements indicates that the initial downhole toolface orientation has changed to the intended downhole toolface orientation.

14. The method of claim 9 wherein the processing device operation comprises, before performing the slide drilling operation and while the drill string is off-bottom, determining the base rotational distance based on the rotational distance measurements and torque measurements indicative of torque applied to the drill string by the top drive.

15. The method of claim 14 wherein determining the base rotational distance comprises determining the base rotational distance as being equal to a predetermined fraction of a rotational distance achieved by the top drive at a maximum torque applied to the drill string by the top drive.

16. A method comprising:

commencing operation of a processing device communicatively connected to a well construction system comprising a top drive, wherein the processing device operation causes the top drive to:

impart rotational oscillations in alternating first and second opposite directions to an upper end of a drill string while maintaining an initial downhole toolface orientation during a slide drilling operation, wherein each rotational oscillation is through a base rotational distance; and change the initial downhole toolface orientation to an intended downhole toolface orientation by:

adding an offset rotational distance and an overshoot rotational distance to the base rotational distance of an instance of the rotational oscillations in the first direction oscillations, wherein the overshoot rotational distance is determined from the offset rotational distance and a length of the drill string; and adding the overshoot rotational distance to the base rotational distance of an instance of the rotational oscillations in the second direction.

17. The method of claim 16 wherein:

the processing device operation comprises determining when the initial downhole toolface orientation changes to the intended downhole toolface orientation based on measurements of torque applied to the drill string by the top drive;

a changing average value of the torque measurements indicates that the initial downhole toolface orientation is changing and therefore did not yet change to the intended downhole toolface orientation; and a substantially constant average value of the torque measurements indicates that the initial downhole toolface orientation has changed to the intended downhole toolface orientation.

18. The method of claim 16 wherein the processing device operation comprises, before performing the slide drilling operation, determining the base rotational distance by, while off-bottom:

outputting a command causing the top drive to rotate the drill string;

receiving measurement data indicative of torque and corresponding rotation imparted by the top drive in response to the output command;

determining a reference rotational distance as being the measured rotation that corresponds to a maximum of the measured torque; and determining the base rotational distance as being a predetermined fraction of the reference rotational distance.

* * * * *